United States Patent [19]

Klaus

[11] 4,217,012

[45] Aug. 12, 1980

[54] STORAGE UNIT

[75] Inventor: Gerald R. Klaus, St. Charles, Ill.

[73] Assignee: Fellowes Manufacturing Company, Itasca, Ill.

[21] Appl. No.: 963,997

[22] Filed: Nov. 27, 1978

[51] Int. Cl.[2] ..... E06B 9/14; A47B 81/00

[52] U.S. Cl. ..... 312/292; 312/293; 312/297; 312/111

[58] Field of Search ..... 312/297, 291, 292, 293, 312/295, 108, 111, 235 R

[56] References Cited

U.S. PATENT DOCUMENTS

| | | | |
|---|---|---|---|
| 194,890 | 9/1877 | Camp et al. | 312/111 |
| 228,627 | 6/1880 | Gordon | 312/297 |
| 262,312 | 8/1882 | Rearden | 312/293 |
| 505,030 | 9/1893 | Cox | 312/297 |
| 656,556 | 8/1900 | Lind | 312/297 |
| 885,364 | 4/1908 | McComb | 312/297 |
| 1,331,143 | 2/1920 | Chriskos | 312/297 |
| 1,740,888 | 12/1929 | Davidson | 312/297 |
| 2,210,019 | 8/1940 | Zalkind | 312/108 |
| 2,379,179 | 6/1945 | Petersen | 312/140 |
| 3,348,894 | 10/1967 | Berry | 312/235 R |

*Primary Examiner*—Victor N. Sakran

*Attorney, Agent, or Firm*—Roy E. Hofer; Joan I. Norek

[57] ABSTRACT

There is provided an improved storage unit including a framed shell and a storage-compartment insert that is to remain stationary during use, wherein an open end is provided for access to the storage compartment, which open end is enclosed by a vertically moveable door which is guided on tracks on the sides of the shell's frame and is received into a space between the top of the shell and the top of the insert.

7 Claims, 7 Drawing Figures

FIG. 1
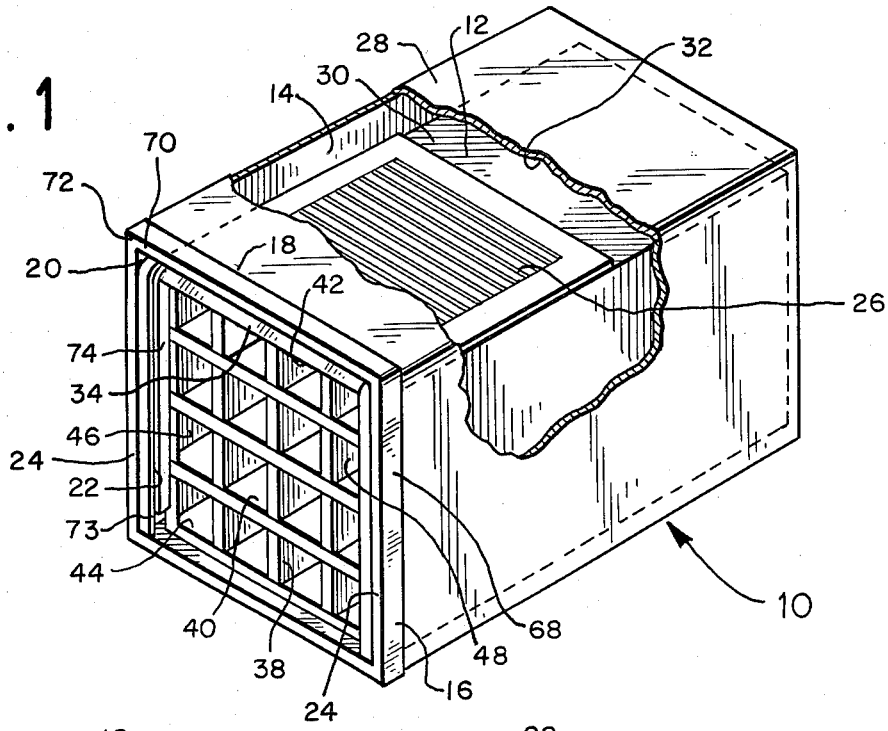
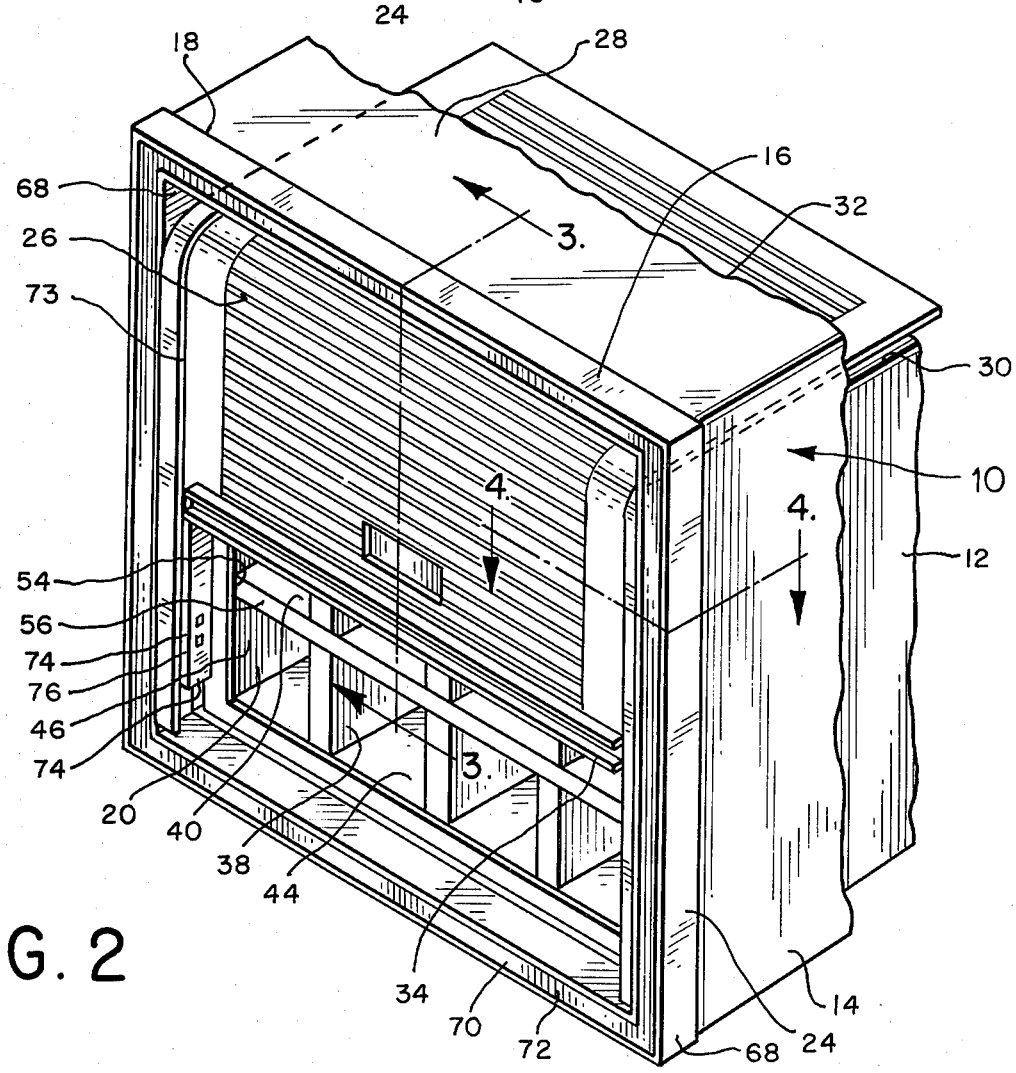
FIG. 2

STORAGE UNIT

TECHNICAL FIELD

This invention relates to the technical field of storage units, particularly storage units for offices and the like for storing documents, particularly documents that are rolled into tubular form for storage. This invention relates particularly to the technical field of office storage units that are constructed of fiberboard, which provide sufficient strength and durability while minimizing the cost, and are sufficiently light weight to be easily portable.

BACKGROUND OF THE INVENTION

Fiberboard storage units generally include a shell for housing a storage compartment or insert that can be a drawer or a unit of partitions. The shell itself generally includes four sides and possibly an open end when a drawer is to be housed therein. The drawer front generally encloses the open end of the shell. When the storage compartment insert is a unit of partitions, such as a unit with vertical and horizontal partitions forming a grid, such insert is designed to be stationarily positioned within the shell during use; i.e., it is not generally moved out or in during use. Such a grid insert therefore is generally not fronted. It has at least a forward open end to allow access to the contents within. Such storage units, therefore, preferably include a means for enclosing the front of the shell itself, such as a door.

When these storage units, or at least the shell thereof, are formed with fiberboard (the preferable construction material for inexpensive office storage units), enclosing the front of the shell with a conventional door has distinct disadvantages. Conventional doors require hinges and closure hardware, increasing the cost of the unit and the weight thereof. The hinges need to be connected to the fiberboard sides of the shell, and securement of any conventional fastening means, such as that formed of metal, to a fiberboard unit diminishes the structural integrity of that unit.

Moreover, fiberboard storage units are designed specifically to be light in weight. A conventional door, when swung outwardly to the side of the unit, tends to unbalance the storage unit and requires a significant amount of forward space. Forming the door and units with a center opening reduces the amount of forward space necessary to open these storage units, but requires the storage shell to be hinged at both sides, multiplying the adverse effects of hinging to a fiberboard shell. A shell may be less unbalanced if the door opened upwardly or downwardly, but a downward opening door would block simultaneous access to a storage unit below, and an upwardly opening door would be inefficient unless it could be swung backwards over the top of the shell, an impossible arrangement if the storage units are stacked one on top of the other.

A storage unit for a plurality of partitions that are to remain stationary during use could, of course, be constructed without a front door. However, the type of documents generally stored therein, such as blue prints and the like, would become dusty and could be damaged by being stored open.

It is an object of the present invention to provide a storage unit for documents and the like, including a shell, in combination with an insert that can remain stationary, wherein an improved means for enclosing the end of the storage unit is provided. It is an object of the present invention to provide such a storage unit with a front enclosure that does not swing out from the storage unit when access is desired. It is an object of the invention to provide such a storage unit with a door that requires no conventional hinges or other means of securement that perforate the sides of the unit, particularly a storage unit formed of fiberboard or the like. It is a further object of the invention to provide a storage unit including a shell that is reinforced with a channeled frame whereby the means for opening and closing the door are formed on the frame rather than on the fiberboard portion of the storage unit. It is a further object of the invention to provide an insert that is aligned both with the frame and the means for guiding the door so that no shoulder is formed rearward of the frame or guided means that would hamper access to documents stored behind them.

DISCLOSURE OF THE INVENTION

These and other objects are realized in accordance with the invention by a combination of a shell housing and insert that is reinforced by a channeled frame receiving the forward edge of the shell, and vertical guide means positioned at the sides of the frame, which guide means secures a flexible tambour or roll-top door. The guide means may be tracks formed integrally with the frame, and the insert and shell may be formed so as to have spaced-apart top walls, leaving an upper storage area for the door. The door is movable vertically on the track and is generally provided with a suitable stop means near its bottom edge. The door is of suitable height so that a portion thereof is disposed within the upper storage area when fully closed. The storage area is sufficiently deep so as to receive substantially the entire length of the door above the handle, the stop means acting as a means for stopping the door so that it is not completely received into the storage space.

BRIEF DESCRIPTION OF THE DRAWINGS

FIG. 1 is a partially cut-away perspective view of a storage unit shown open and embodying features of the present invention;

FIG. 2(*a*) is a further cut-away view of FIG. 2;

PREFERRED EMBODIMENTS OF THE INVENTION

Figure 2A:
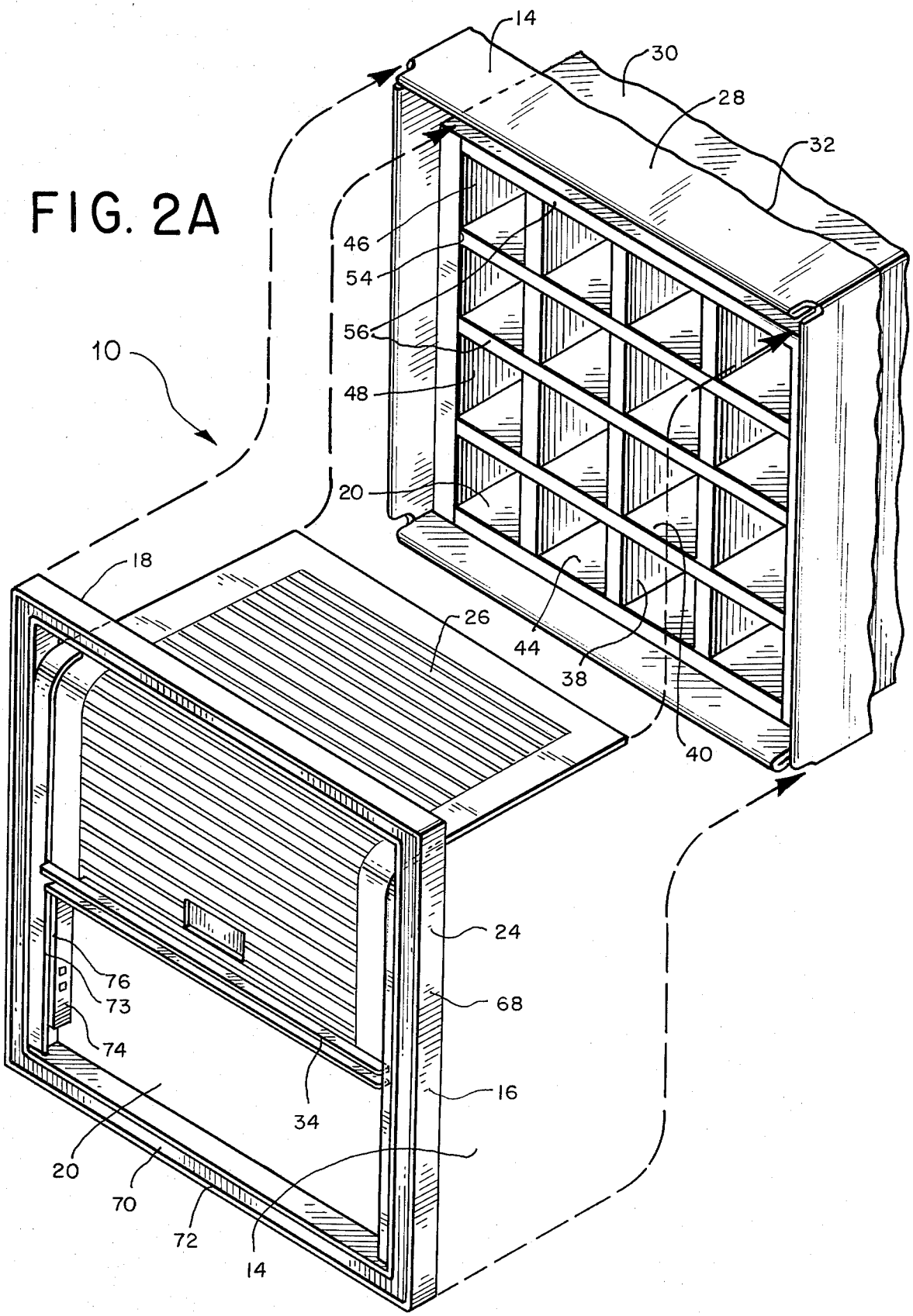
FIG. 2 is a fragmented enlarged view of the front of the storage unit of FIG. 1, shown partially closed.
Figure 3:
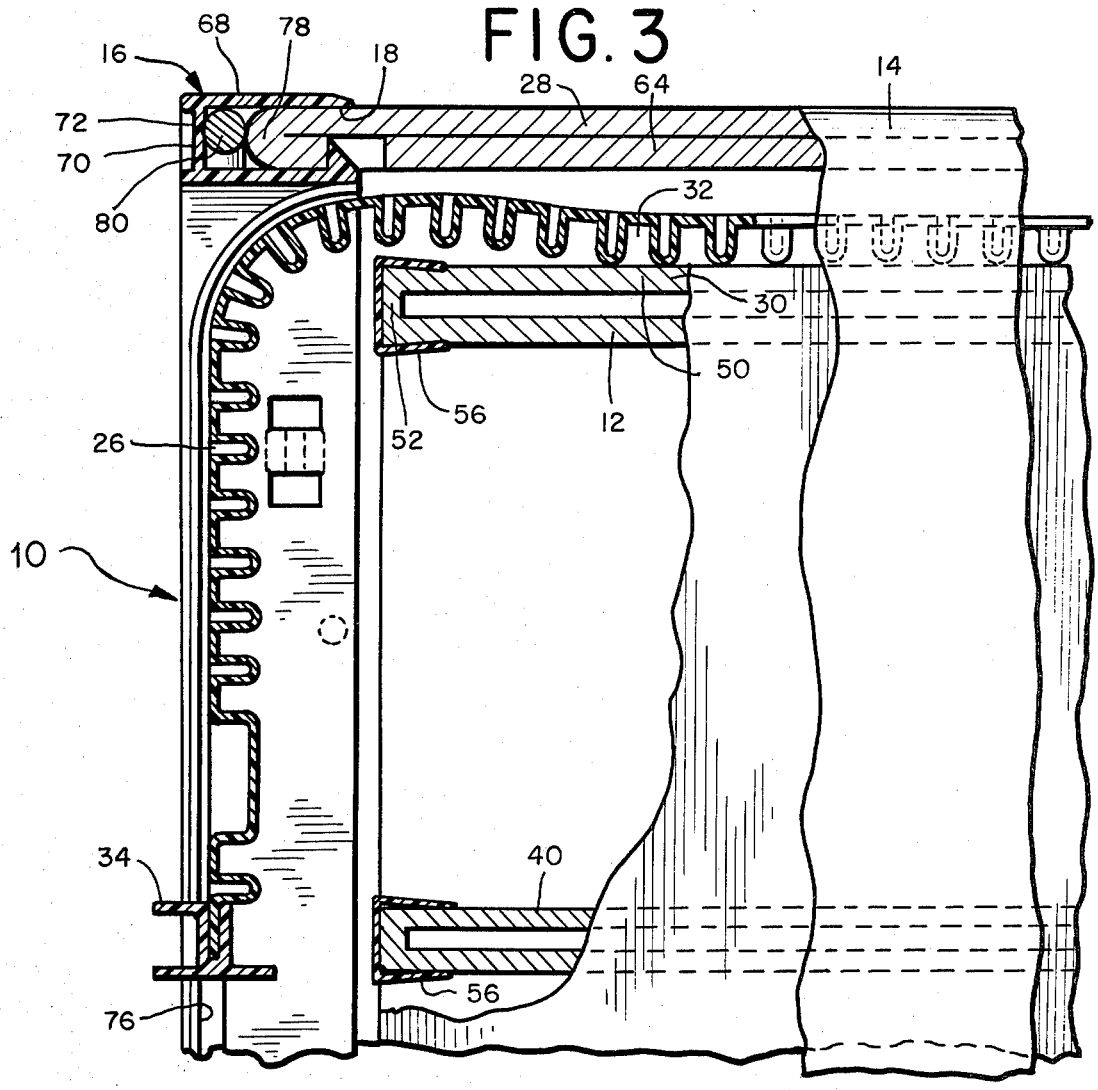
FIG. 3 is a cross-sectional view of the storage unit of FIG. 1, taken along line 3—3 of FIG. 2.
Figure 4:
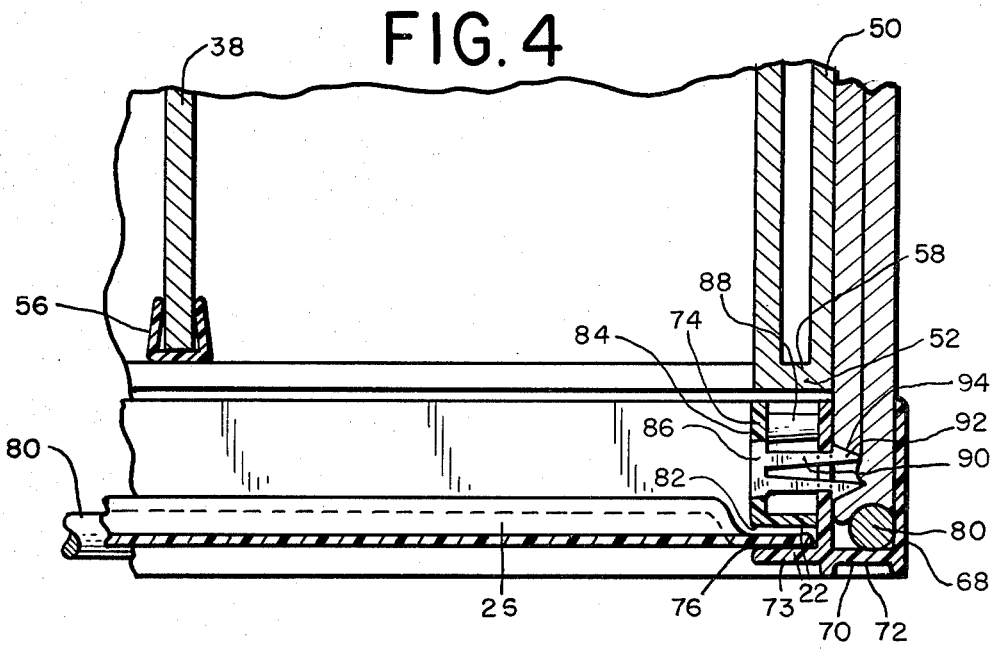
FIG. 4 is a cross-sectional view of the storage unit of FIG. 1, taken along line 4—4 of FIG. 2.
Figure 5:
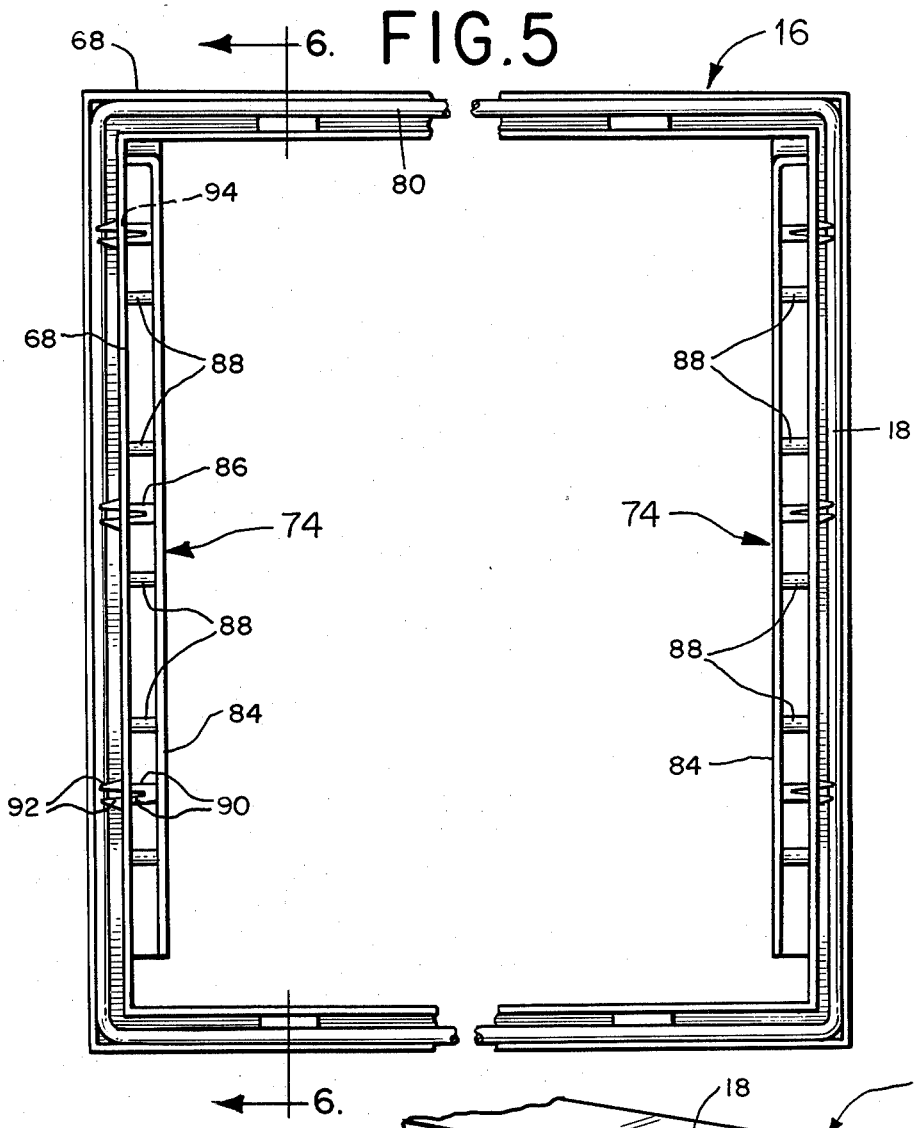
FIG. 5 is a rear elevational view of the frame of the storage unit of FIG. 1, embodying features of the present invention.
Figure 6:
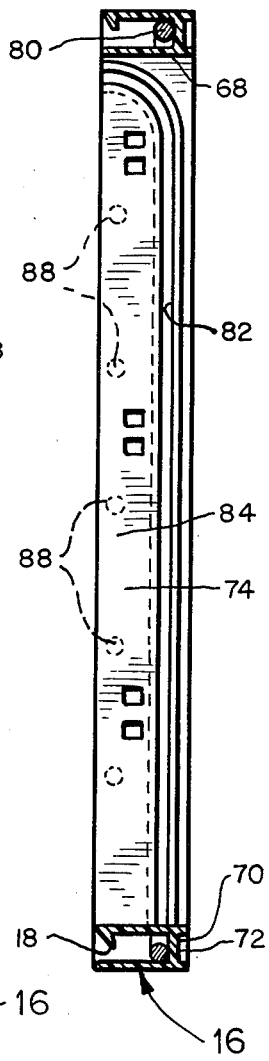
FIG. 6 is a cross-sectional view of the frame of the storage unit of FIG. 1, taken along line 6—6 of FIG. 5.
Figure 7:
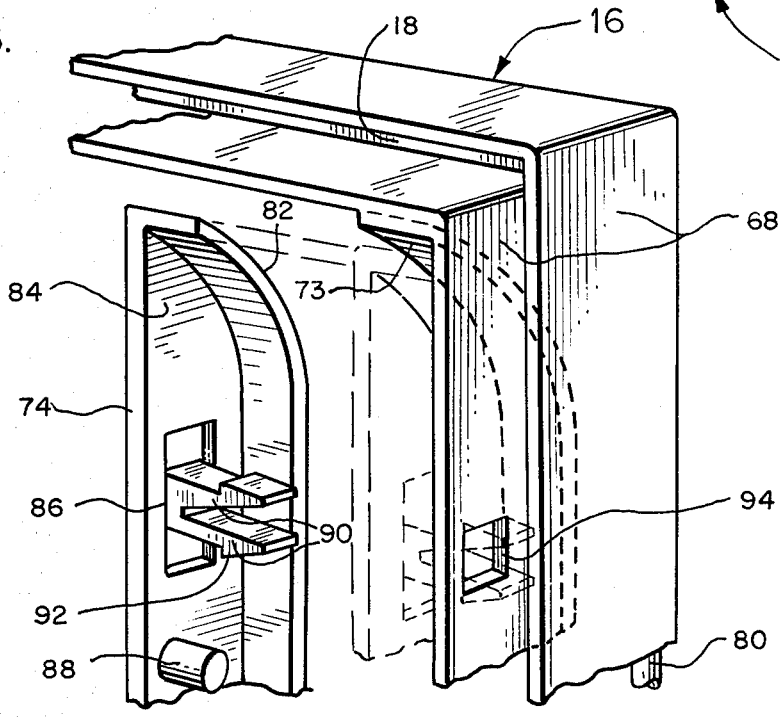
FIG. 7 is an exploded fragmented perspective view of the frame of the storage unit of FIG. 1.

Referring to the drawings, particularly to FIG. 1, there is illustrated an improved storage unit, designated by the reference No. 10, embodying features of the present invention. The storage unit 10 includes an insert, designated generally 12, constructed to be stationarily disposed within an outer shell, designated generally 14. The shell 14 is reinforced by an external frame 16 having a continuous channel 18 that receives the edge (not shown) of the open end 20 of the shell 14. The frame 16 is formed with vertical guide means or rails 22 along each of its two sides 24, the rails 22 extending inwardly toward each other. A roll-top or tambour door 26 is also provided to enclose the open end 20 of the shell 14; i.e., to enclose the front of the storage unit 10. The shell 14 and insert 12 are respectively formed having suitable heights so that their respective top walls 28, 30 are spaced-apart, leaving a void or storage area 32 therebetween, the opening of which is hidden behind the frame 16. The door 26 is guided by the rails 22 so as to move along the vertical. The door's uppermost end is still disposed within the door storage area 32 when the door 26 is closed. The door storage area 32 receives the entire door 26 up to its stop means 34 positioned close to the door's bottom. The stop means 34 is shown as a bottom door frame, but it could also be formed as a conventional handle.

The storage unit 10 is provided with a door 26 that can easily be opened and closed, requires no conventional hardware that could perforate any portion of the storage unit 10, and requires no space in front of the storage unit 10 for opening. Moreover, the door 26 may be constructed of light weight material and does not swing open in any manner so it cannot unbalance the storage unit 10. The door 26, requiring no space for opening, does not interfere with storage units stacked above, below, or at the sides.

Refering now to FIGS. 2, 2(*a*), and 3 also, the insert 12 includes a plurality of vertical and horizontal partitions 38, 40 forming a grid of storage compartments 42 particularly suitable for storing rolled documents such as blue prints and the like. The insert 12 preferably includes a peripheral bottom wall 44 and opposed sides 46 extending between the bottom wall 44 and the top wall 30. Such insert 12 can be formed of fiberboard as is well known to those of ordinary skill in the art with at least one open end 48 to allow access to the documents stored therein. The top wall 30, bottom wall 44, and sides 46 are preferably formed by folding free edged flap extensions 50 of these walls back upon themselves to form a double-layered edge 52 about its open end 48. The vertical and horizontal partitions 38, 40 are secured at their ends to the respective wall by providing it thereon tabs that fit into slots in the wall, or as shown, by providing separate channeled frames 56 that receive the forward edges of the partitions 38, 40, and the upper and bottom insert walls 30, 44, wherein the frames 56 of the horizontal partitions 40 extend thereby and into slots 54 in the insert sides 46.

It is extremely desirable that the inner surface of any of the walls of the insert 12 are aligned with the front opening of the storage unit 10. Since the front opening of the storage unit 10 herein is defined by the frame 16 and the inwardly-extending rails 22, a conventional grid insert is disadvantageous. The insert 12 herein is preferably double-scored at its side edges 58 so as to provide additional width at its sides 46 and thereby align with the inner edges of the rails 22 so that no internal shoulder is formed that could obstruct access to the documents stored in the sidemost storage compartment 42.

The shell 14 is formed with an open end by folding free edged panels 64 back and inwardly upon the sides of the shell 14 from which they extend. The continuous channel 18 of the frame 16 is formed by two spaced apart leg members 68 and a forward base member 70 which interconnects the leg members 68 and forms the frame front 72. The rails 22 may be formed integrally with the two opposed frame sides 24 that are disposed vertically. It is preferred to form the rails 22 with a forward rail 73, formed integrally with the frame, and a removable rear member 74, described in more detail below. The rails 22 are formed in pairs on each respective vertical frame side 26 to form opposed tracks 76 which guide the vertical movement of the door 26. The frame 16 including the tracks 76 may be formed of any suitable material, such as metal or light weight plastic.

The frame 16, with its continuous channel 18 that receives the edge 78 of the shell 14, a double layered edge 78, between its spaced-apart leg members 68, reinforces the shell 14. The frame 16 may further include a continuous reinforcing bar 80, preferably of circular cross-section, disposed within the channel 18 adjacent the base member 70 so as to be disposed forward of the shell edge 78 sandwiched therein.

As mentioned above and as best shown in FIGS. 4 to 7, the opposed tracks 76 are preferably formed between a forward rail 73 and a removable rear member 74. The forward rail 73 is preferably formed integrally with the member 16. The spaced-apart leg members 68, as shown, extend slightly forward of the base member 70, and the forward rails 73 are disposed inwardly, adjacent the inward leg member 68, substantially coplanar with the base member 70, except near the upper position of the frame sides 24, where the front rail 73 curves rearwardly. The removable rear members 74 each include a forward face 82 and rearwardly extending base 84 from which extend three flange-clips 86 each flanked by at least one spacing bar 88, preferably formed integrally with the base 84. The flange-ended clips 86 each have two spaced-apart arms 90 ending in oppositely extending flanges 92, and are formed of suitable material, such as medium weight plastic, to have a limited degree of flexibility. These clips 86 snap into slots 94 provided therefor in the inner leg member 68 of the frame 16, the flanges 92 passing through the slots 94. The spacing bars 88 prevent movement of the rear member 74 closer to the adjacent leg member 68 than desired. The removability of the rear member 74 facilitates assembly, and its forward face 82 forms the rear portion of the tracks 76 and follows the front rail 73.

Forming the mean for securing the door 26 as a portion of the frame 16 avoids perforating any fiberboard portion of the storage unit 10, such as the insert 12 or the shell. The door 26, by being received into the storage unit 10 itself when open, avoids the necessity for providing space for swinging in front of the unit 10 or obstructing adjacent units or other containers disposed next to, above, or below the storage unit 10. Although the storage unit 10 can be adapted to hold inserts 12 other than that formed with a grid of storage compartments 42, it is particularly adapted to such type of storage compartments, which are intended to remain stationary during use, and which are in particular need of a separate front closure means. The grid of storage compartments 42 illustrated, although stationarily housed in the shell 14, can easily be removed from the shell 14 by removal of the frame 16, tracks 76, and door 26.

The storage unit 10 of the present invention provides a movable front closure from a stationary insert 12 that requires no further space for opening than that taken up by the storage unit 10 itself, requires no additional hardware other than the tracks 76 formed together with the frame 16 and any stop means 34 on the door 26. The door 26 can be made of light weight plastic corrugated to provide durability together with flexibility.

INDUSTRIAL APPLICABILITY

The storage unit of the present invention provides a durable, reinforced housing for a storage compartment of plurality of storage compartments that are to remain stationary during use and a front closure for the open end of the unit. When the shell and insert are formed of fiberboard, the entire storage unit is light weight and constructed with the minimum expense. The door itself can be constructed of light weight plastic, that is vinyl or the like, and the frame and track can be formed of medium weight plastic, all providing an inexpensive storage unit for use in offices, factories, or the like. There are no protruding members on the storage unit, allowing them to be stacked closely adjacent one another at the sides, or above and below. The unit can be dismantled for easy storage and shipping and is particularly suitable for holding rolled documents such as blue prints and the like.

While several embodiments described herein are at present considered to be preferred, it is understood that various modifications and improvements may be made therein, and it is intended to cover in the appended claims all such modification and improvements as fall within the true spirit and scope of the invention.

I claim:

1. An improved storage unit for documents and the like, comprising, in combination:

a fiberboard insert having a top wall, bottom wall, and two opposed side walls extending therebetween, said insert walls forming at least one open end;

a fiberboard shell having a top wall, bottom wall, and two opposed side walls extending therebetween, said shell walls forming at least one open end;

a shell frame formed with two spaced-apart legs and an interconnecting base forming a continuous channel that receives the edge of said open end of said shell;

a flexible door;

said insert being disposed within said shell with said top wall of said insert and said top wall of said shell being spaced apart to define a door storage space therebetween; said flexible door being of suitable height to be partially disposed within said door storage area when enclosing said open end of said shell;

said flexible door being guided at its opposed side edges by tracks extending along the side walls of said shell, said tracks each being formed of a front and a rear rail;

said front rails being secured to the inward legs of said frame; and said rear rails each comprising a forward face, which together with said front rail define a guide path for said flexible door side edge, and a base extending away from said front rail, said base including means for maintaining said rear rail in a fixed position relative the adjacent inward leg of said frame and for removing said rear rail from said frame.

2. The storage unit of claim 1 further including a stop means positioned adjacent the lower edge of said door to prevent movement of the entire door into said door storage space.

3. The storage unit of claim 1 wherein said shell frame further includes a rigid reinforcing bar disposed within said channel forward of said edge of said shell received by said channel.

4. The storage unit of claim 1 wherein said insert is formed with sides which are each double scored so as to outstand from said sides of said shell a sufficient distance so as to align the side edges of its open end with the inward edges of said tracks.

5. The storage unit of claim 1 wherein said insert further includes a plurality of vertical and horizontal partitions forming a grid.

6. The storage unit of claim 1 wherein said means for maintaining and removing said rear rail includes at least one flange-ended clip flanked by at least one spacing bar, said clip and said bar extending toward said adjacent inward leg of said frame, and wherein said inward leg of said frame includes a slot opposite said clip that receives said clip's flanged end.

7. An improved storage unit comprising:

a fiberboard shell housing a fiberboard insert, each having at least four walls forming coincident open ends, the open end of said shell being defined by the forward edges of said four walls;

a continuous four-sided channelled frame receiving the forward edges of said shell walls that define its open end, said frame further including a front and a rear rail on each of two opposed frame sides, at least said rear rail being detachable from said frame;

said rails receiving and guiding a flexible door for said open end of said shell, the opposed sides of said door being disposed between said rails;

said shell and insert having at least one of their adjacent walls spaced apart to receive said flexible door;

said frame being detachable from said shell; and said rear rail including a base member extending opposite said front rail, said base member including means for attaching and detaching said rear rail to said frame.

* * * * *